United States Patent [19]

Baker

[11] Patent Number: 4,768,923

[45] Date of Patent: Sep. 6, 1988

[54] COMBINED WATER PUMP, BEARING AND SEAL ASSEMBLY

[75] Inventor: Steven F. Baker, Bellevue, Ohio

[73] Assignee: General Motors Corporation, Detroit, Mich.

[21] Appl. No.: 59,935

[22] Filed: Jun. 9, 1987

[51] Int. Cl.[4] ..... F04D 29/10

[52] U.S. Cl. ..... 415/170 A; 415/219 C; 415/201; 277/9; 277/93 SD

[58] Field of Search ..... 415/170 A, 219 C, 201, 415/173 R, 174; 277/9, 9.5, 58, 65, 93 R, 93 SD

[56] References Cited

U.S. PATENT DOCUMENTS

| | | | |
|---|---|---|---|
| 2,989,925 | 6/1961 | Brehm et al. | 415/170 A X |
| 3,620,042 | 11/1971 | Gray | 415/170 A X |
| 3,632,220 | 1/1972 | Lansinger et al. | 415/170 A X |
| 3,782,735 | 1/1974 | Novosad | 277/92 X |
| 3,895,811 | 7/1975 | Richard, Jr. et al. | 277/65 X |
| 3,934,966 | 1/1976 | Asberg | 415/170 A X |
| 3,981,610 | 9/1976 | Ernst et al. | 415/170 A X |
| 4,243,233 | 1/1981 | Arai | 415/174 X |
| 4,669,738 | 6/1987 | Netzel | 277/65 X |

FOREIGN PATENT DOCUMENTS

| | | | |
|---|---|---|---|
| 2172659 | 9/1986 | United Kingdom | 415/182 |

*Primary Examiner*—Robert E. Garrett

*Attorney, Agent, or Firm*—Patrick M. Griffin

[57] ABSTRACT

A vehicle water pump includes a unit handled assembly comprising a bearing housing, pump housing, and annular wear face sealing element, all made of suitable steels and alignable relative to one another at a common, accessible juncture of three circular edges. The components can thus all be welded together to give an easily handled unit, and the metal wear face has a much improved alignment, life and running temperature, as compared to a conventional ceramic wear face.

2 Claims, 1 Drawing Sheet

COMBINED WATER PUMP, BEARING AND SEAL ASSEMBLY

This application relates to vehicle water pumps in general, and specifically to the type of water pump in which a relatively rotatable sealing ring frictionally bears on a seal wear face so as to exclude coolant from a pump bearing.

BACKGROUND OF THE INVENTION

Vehicle cooling systems generally include a belt driven water pump with a belt driven shaft and shaft mounted impeller to drive coolant through the system. Typically, a pump housing is detachably connected to the engine block and a shaft supporting bearing assembly is press fitted within a sleeve of the housing. It is also known to integrate the outer race of the bearing assembly with the pump housing, which, at least theoretically, has the potential to reduce cost and complexity by eliminating a part. An example may be seen in U.S. Pat. No. 3,981,610. Such integrated pump housing and bearing assemblies have found little or no practical production use, however. This is because a steel suitable for a bearing race and pathway must be quite hard. Conversely, a typical pump housing is relatively large and includes complex, passage defining curvatures, and must be formed of a soft steel to be easily stamped.

The greatest challenge in the design vehicle water pumps, however, is universally recognized to be sealing, a problem which has still not been solved to the industry's complete satisfaction. It is possible to use a magnetic impeller driving means which needs no seal. However, a magnetic drive means is, as yet, relatively costly. When a conventionally driven impeller is used, some type of rubbing seal must be used, since the impeller driving shaft must physically extend into the pump housing. The location where a seal must be placed is the space between the shaft support bearing and the shaft impeller. Any seal in that location inevitably sees the hot and corrosive coolant, which is very detrimental to common seal materials. The standard industry water pump seal includes two basic parts, a sealing ring, and a sealing element with a wear face that the sealing ring runs against. One part of the seal is mounted to the pump housing-bearing structure, and the other to the impeller-shaft structure. Therefore, in addition to the corrosive, hot coolant, the sealing ring wear face interface sees the considerable heat of friction of the very rapid relative shaft-bearing rotation. Because of the inevitable wear at this interface and the high pressure of the hot coolant, it has also been found necessary to spring bias the ring and wear face together to maintain firm contact, which increases the heat of friction.

The standard industry response to the sealing problem has been to make the wear face from a non corroding ceramic material, and to make the sealing ring of a differing non corroding material, such as carbon. However, ceramic itself presents so many practical problems that the majority of issued patents in the art seem to deal almost exclusively with proposed solutions to the inherent difficulties of using ceramic. Ceramic is brittle, very subject to thermal shock, difficult to lap to a flat surface, and extremely difficult to structurally mate with the steel components of the rest of the pump. For example, U.S. Pat. No. 3,782,735 proposes putting a tight metal band around the ceramic sealing element to try to maintain its structural integrity. To mate the ceramic to the metal impeller shaft, an elastomer isolator is used, which would allow the ceramic ring to wobble, potentially threatening the alignment and integrity of the sealing interface. The elastomer also acts as an insulator, preventing the ceramic from shedding the heat of friction. The ceramic seal element is better handled in the pump design disclosed in U.S. Pat. No. 3,895,811, also assigned to the assignee of the present invention. There, the ceramic element is firmly set into and held by surrounding deformable metal washers, which keeps the ceramic square to the other part of the seal, and which provides better heat dissipation. However, cost considerations have prevented production adoption of this design, and the conventional seal of the type described is very widely used.

SUMMARY OF THE INVENTION

The subject invention provides a combined water pump, bearing and seal assembly that overcomes all of the shortcomings noted above. The invention is more economically and precisely assembled, and operates with improved durability and seal life.

In the preferred embodiment disclosed, the normally ceramic sealing element is replaced by one made from a suitably wear and corrosion resistant metal, specifically an annular ring of stainless steel. This eliminates all the inherent drawbacks of ceramic. The pump housing is formed of a metal that is suitably soft so as to be easily stamped, specifically dead soft steel. A generally cylindrical bearing housing is formed of a metal, specifically bearing quality steel, which is suitably hard to provide integrally formed pathways for a complement of rolling bearing elements, which rotatably support the impeller shaft. Although the pump housing, bearing housing and sealing element are all formed of differing steels which are specifically suited to their unique requirements, they are all three weldable, and have similar thermal expansion characteristics, unlike the inherently incompatible steel and ceramic.

In addition, each of these three components is specifically designed so as to allow a particularly advantageous manufacture. The cylindrical bearing housing has a circular end edge, and the pump housing has a central opening with a circular inner edge of substantially equal diameter. The annular sealing element has a circular outer edge with a diameter that is comparable in diameter to the circular edges of the bearing and pump housings. These three edges may be brought together at a common, accessible juncture and simultaneously welded together, giving a unitary assembly of the three components. This would not be possible with ceramic, and the resultant unitary assembly is as convenient to ship, handle and install as other unitary assemblies, even more so since the wear face is also part of the unit. Every component is made of the material that best suits its unique requirements, with no forced compromises. Since the steel of all three components has similar thermal expansion characteristics, the structural integrity of the common juncture is maintained during pump operation.

The structure of the specific embodiment disclosed provides additional advantages in a cooperative and interactive fashion, at no added cost in terms of either material or processing. The weld at the juncture also provides a fluid tight seal at the common juncture. The wear face of the stainless steel sealing element is radially proximate to the welded common juncture of the three components. Being metal, the heat of friction in the wear face is efficiently conducted through the common juncture to the bearing housing and the pump housing, and thence to the ambient. The end edge of the bearing housing is provided with a shoulder that fits within the edge of the pump housing opening, and the sealing element is provided with a peripheral flange that abuts the end edge of the bearing housing. Thus, before the three components are welded together, they are held in very precise relation, and the alignment seal interface is much more accurately controlled than with a conventional ceramic seal.

It is, therefore, an object of the invention to provide a vehicle water pump in which the bearing housing, pump housing and seal can all be formed from the most suitable materials, but still comprise unitized assembly.

It is another object of the invention to provide such a unitary assembly in which a metal sealing element with a wear face is incorporated in such a way as to efficiently rid itself of the heat of friction in cooperation with the other components of the assembly.

It is yet another object of the invention to provide such a unitary assembly in which the components cooperatively align with each other when assembled, so as to be even more easily manufactured, and so as to precisely and accurately locate the seal for improved operation.

DESCRIPTION OF THE PREFERRED EMBODIMENT

These and other objects and features of the invention will appear from the following written description, and from the drawings, in which.

Figure 1:
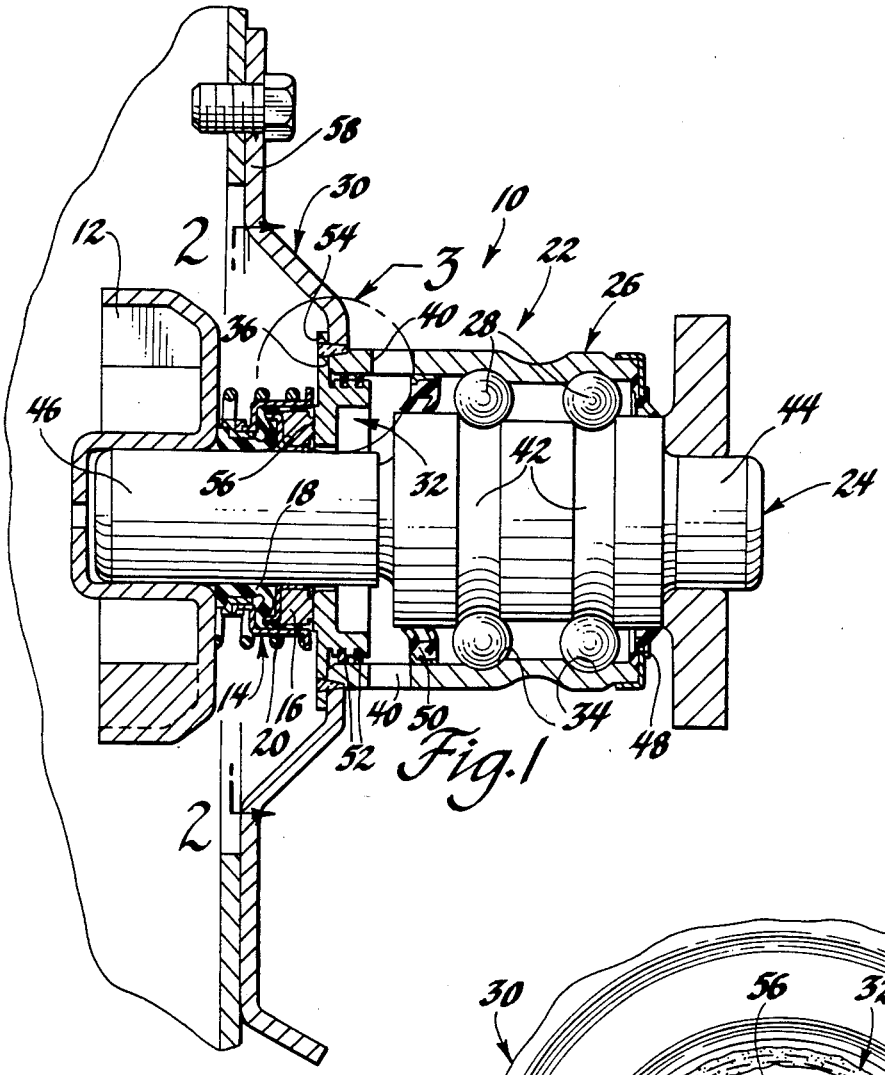
FIG. 1 is a side view of the preferred embodiment of the invention, showing some parts in cross section and some in elevation.

Referring first to FIG. 1, a preferred embodiment of a vehicle water pump incorporating the invention is designated generally at 10. Pump 10 is shown as it would be shipped, as a unitary assembly separate from the non-illustrated engine block, to which it would be later installed. In fact, two of the basic components of water pump 10 are conventional, and do not comprise part of the invention in the broadest sense, although it would be most practical to assemble and ship those components with the invention as part of an overall assembly. The two conventional components are the impeller, designated at 12, and the cartridge seal, designated generally at 14. Impeller 12 is a standard stamped metal design, familiar to those skilled in the art. Cartridge seal 14 is a typical commercially available unit, and includes a carbon sealing ring 16, a bellows 18, and a biasing spring 20 that is compressed between sealing ring 16 and impeller 12. The invention comprises a more basic unitary assembly, designated generally at 22, which includes a shaft designated generally at 24, a bearing housing designated generally at 26, a double row complement of bearing balls 28 that support shaft 24 concentrically within bearing housing 26, a pump housing designated generally at 30, and a sealing element designated generally at 32. Each of these components, and the way in which they are specifically designed to cooperate, will be described in detail below.

Figure 3:
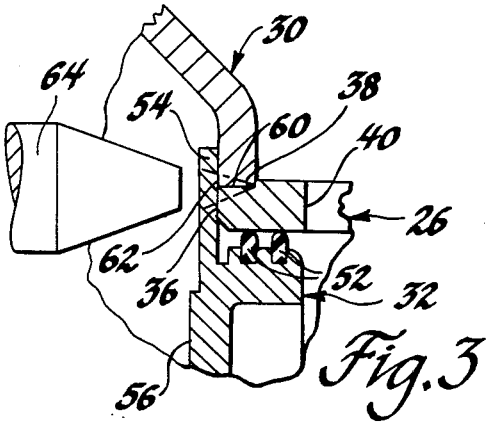
FIG. 3 is an enlargement of the circled portion of FIG. 1 prior to welding.

Still referring to FIGS. 1 and 3, bearing housing 26 is generally cylindrical, and formed of bearing quality steel such as AISI 52100 or 1040 high carbon steel. As such, it is suitably hard to have integral bearing pathways 34 formed on the inner surface thereof. Being cylindrical, bearing housing 26 has generally circular end edges, one of which, 36, is formed with a notched shoulder 38. Bearing housing 26 is also formed with standard vent holes 40 for venting any coolant that does leak past seal 14. Shaft 24 is formed of the same material as bearing housing 26, and also has bearing pathways 42 integrally formed on the outer surface thereof. Shaft 24 is turned down at one end, 44, so that a conventional drive pulley (not shown) may be mounted thereto, and also at the other end, 46, so that impeller 12 may be mounted thereto. After shaft 24 and housing 26 are manufactured and suitably heat treated, the double row complement of bearing balls 28 is conrad assembled between the respective pathways 42 and 34 thereof in conventional fashion. There is sufficient radial clearance between the bearing housing 26 and shaft 24 to allow unobstructed access for the addition of the bearing balls 28 and any desired lubricant supply therefor. Next, suitable lip seals 48 and 50 are added to enclose the balls 28. At this point, the bearing housing 26, shaft 24 and balls 28 constitute a bearing subassembly that may be separately handled.

Still referring to FIGS. 1 and 3, sealing element 32 is generally annular in shape, and is formed of a suitably corrosion resistant metal, in this case, AISI 303 stainless steel, although other materials, such as oil impregnated cast iron could be used. Both materials have excellent wear characteristics, and far easier to produce and handle, and can tolerate thermal and mechanical shock far better than ceramic. Being steel or other ferrous metal, sealing element 32 has thermal expansion characteristics similar to the bearing housing 26, and is weldable. Beyond the generally annular shape, there are specific structural details of sealing element 32 that cooperate with the other components, and which may be best seen in FIG. 3. The main body of sealing element 32 is sized just slightly smaller than the inside diameter of bearing housing end edge 36, so that sealing element 32 may be slip fitted into the end of bearing housing 26. A pair of O-rings 52 are sized so as to wipingly engage the inside surface of bearing housing 26. A peripheral flange 54 has an outside diameter somewhat larger than the outside diameter of bearing housing shoulder 38, and is abuttable with end edge 36. A raised wear face 56 faces outwardly, and is proximate to the flange 54, both radially and axially. Pump housing 30 is stamped of AISI 1010 dead soft steel. Consequently, pump housing 30 may be easily formed into the complex and convoluted shape that is generally necessary in a pump housing, with its integral coolant entry and exit passages and peripheral attachment flange 58. Being steel pump housing 30 is also weldable, and has thermal expansion characteristics similar to both bearing housing 26 and sealing element 32. Pump housing 30 is also stamped with a central opening defined by a circular inner edge 60, which has a diameter and thickness substantially equal to the bearing housing shoulder 38. Once again the bearing housing 26, pump housing 30 and sealing element 32 are all formed of different materials that best suit their unique needs. Nevertheless, the similarities of the materials, and the deliberately chosen structural relation of the components, cooperate to give a precise assembly and improved operation for pump 10, as will be next described.

Figure 2:
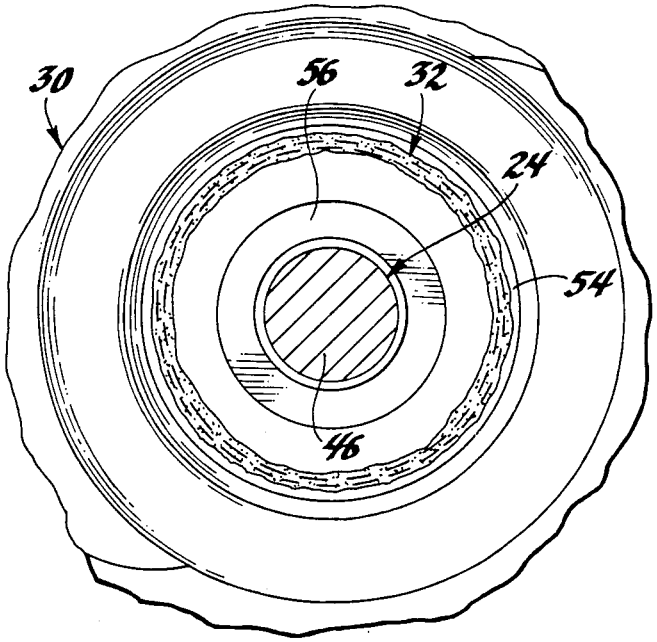
FIG. 2 is a view taken along the line 2—2 of FIG. 1.

Referring next to FIGS. 2 and 3, the relative sizing of bearing housing 26, pump housing 30 and sealing element 32 described above allows them to be assembled and joined as follows. The inner edge 60 of pump housing 30 is seated on bearing housing shoulder 38, so that they are cooperatively located and rigorously coaxially aligned. Next, sealing element 32 is slip fitted within the end of bearing housing 26, which abuts flange 54 with end edge 36. This slip fit and abutment serves to precisely and accurately align sealing element 32 coaxially with bearing housing 32, and also brings wear face 56 square to the axis of shaft 24. This may be compared to the typical mounting of a conventional ceramic sealing element described above, where the ceramic is bedded in elastomer, and hence cannot be nearly as precisely aligned and located. Bringing the bearing housing 26, pump housing 30 and sealing element 32 together as described creates a common juncture of their respective end edge 36, inner edge 60, and flange 54, which is circled in FIG. 3 and designated at 62. The parts may be easily held in this relation temporarily, in a suitable jig or, potentially, in an automated assembling apparatus. As best seen in FIG. 3, the common juncture 62 is readily accessible through the open pump housing 30, and a simultaneous welding together of the three edges may therefore be readily carried out, by a suitable tool, indicated generally at 64. The welding step creates the unitary assembly 22 described above, which may then be as easily handled and shipped as if the three components were integral. However, no compromises as to materials need be made. The welding at the juncture 62 also serves to simultaneously create a continuous fluid tight seal, with no extra steps or seal structure. In fact, the weld seal at the juncture 62 is good enough that the O-rings 52 could likely be eliminated. While the assembly 22 could be shipped as is, it is most convenient to add the cartridge seal 14 and impeller 12, which brings the sealing ring 16 into rubbing engagement with the wear face 56. Then, the pump unit 10 can be shipped whole, and bolted on to the engine block as a unit at the pump housing flange 58.

Referring last to FIG. 1, the materials and assembly described in detail above yield a much improved pump operation and life, primarily because of the improved seal operation and life. As shaft 24 rotates and impeller 12 drives the coolant, the rubbing engagement of sealing ring 16 and wear face 56, in conjunction with the weld at the juncture 62, prevent coolant from exiting to bearing balls 28. Any coolant that does pass the sealing ring 16 is further prevented from reaching the bearing balls 28 by the lip seal 48, and can exit to ambient through the vent holes 40. Although the juncture 62 is subjected to the very hot coolant, the similar thermal expansion characteristics of the three different steels preserve the structural integrity of the weld. Since sealing ring 16 and wear face 56 are so precisely aligned, eccentricity and rubbing wear are minimized. The steel wear face 56 may easily be lapped to sufficient flatness that the carbon sealing ring 16 will actually self-adhere to it. The improved alignment at the seal 16-wear face 56 interface allows a certain amount of corrosion of face 56 to be tolerated, since it will be continually worn off without jeopardizing the alignment of the parts, while the spring 20 assures continuous rubbing contact. Furthermore, since the steel of the sealing element 32 is a good conductor, and since the wear face 56 is proximate the common juncture 62, the heat of friction that is generated at the interface can easily be conducted through the sealing element 32, through the juncture 62, and then to the bearing housing 26 and pump housing 30, both of which are exposed to the ambient air. The cooler running also promotes seal life. Thus, making the seal element 32 of steel, and assembling it as described with the other steel components, yields numerous benefits in terms of cost, manufacturability, and seal life, all in an interactive, cooperative fashion.

Variations of the preferred embodiment disclosed could be made without departing from the spirit of the invention. For example, in a different sized pump or cooler environment, the wear face 56 need not be as proximate to the common juncture 62. Just the fact that sealing element 32 is made of steel and is welded to the bearing housing 26 and pump housing 30 gives improved manufacturability and improved alignment at the rubbing seal interface. However, it is convenient to locate wear face 56 close to the common juncture 62, and to thereby efficiently shed the heat of friction. Likewise, the components could be simplified somewhat by eliminating the bearing housing shoulder 38 and the sealing element flange 54, so long as the bearing housing 26, pump housing 30, and sealing element 32 all had circular edges of approximately the same diameter that could be brought together at a common juncture. However, the various flanges and shoulders described do make the components self-aligning at the common juncture 62, which is also an advantage. Therefore, it will be understood that the invention may be embodied in structures other than that described above, and is not intended to be so limited.

The embodiments of the invention in which an exclusive property or privilege are claimed are defined as follows:

1. A combined vehicle water pump, bearing and seal assembly of the type in which a relatively rotatable sealing ring frictionally bears on a seal wear face, comprising, a rotatable shaft, a generally cylindrical bearing housing formed of a weldable metal suitably hard that the inner surface of said bearing housing may provide integral bearing pathways, said bearing housing having a generally circular end edge, with the outside of said bearing housing being exposed to ambient when said pump is installed, bearing elements supporting said shaft concentrically within said housing, a pump housing formed of a weldable metal with thermal expansion characteristics similar to said bearing housing and sufficiently soft to be easily stamped to a suitable shape, said housing further having a generally central opening defined by an inner edge with a diameter substantially equal to the diameter of said bearing housing end edge, with the outside of said pump housing being exposed to ambient when said pump is installed, and, a generally annular sealing element formed of a weldable metal with thermal expansion characteristics similar to said bearing and pump housings and sufficiently wear resistant to provide said seal wear face, said sealing element further having an outer edge with a diameter substantially equal to the diameter of said bearing housing end edge, said sealing element wear face further being proximate to said sealing element outer edge, whereby said bearing housing end edge, pump housing inner edge and sealing element outer edge may be brought together at a common juncture proximate said wear face and simultaneously welded together to create a unitary assembly and to also thereby create a continuous fluid tight seal at said juncture, said common juncture remaining structurally sound during pump operation because of the similar thermal expansion characteristics of said three metals and with the heat of friction produced at said sealing ring-wear face interface being efficiently conducted from said wear face through said proximate common juncture to said bearing and pump housings and thence to ambient.

2. A combined vehicle water pump, bearing and seal assembly of the type in which a relatively rotatable sealing ring frictionally bears on a seal wear face, comprising, a rotatable shaft to which said sealing ring is mountable, a generally cylindrical bearing housing formed of a weldable metal suitably hard that the inner surface of said bearing housing may provide integral bearing pathways, said bearing housing having a generally circular shoulder at one end edge, with the outside of said bearing housing being exposed to ambient when said pump is installed, bearing elements supporting said shaft concentrically within said housing, a pump housing formed of a weldable metal with thermal expansion characteristics similar to said bearing housing and sufficiently soft to be easily stamped to a suitable shape, said housing further having a generally central opening defined by an inner edge with a diameter substantially equal to the diameter of said bearing housing shoulder, with the outside of said pump housing being exposed to ambient when said pump is installed, and, a generally annular sealing element formed of a weldable metal with thermal expansion characteristics similar to said bearing and pump housings and sufficiently wear resistant to provide said wear face, said sealing element further having a peripheral flange abuttable with said bearing housing end edge, said sealing element wear face further being proximate to said peripheral flange, whereby said bearing housing, pump housing and sealing element may be aligned relative to one another at a common juncture proximate said wear face by sliding said pump housing inner edge over said bearing housing shoulder and then simultaneously welded together at said common juncture to create a unitary assembly and to also thereby create a continuous fluid tight seal at said common juncture, said welded common juncture remaining structurally sound during pump operation because of the similar thermal expansion characteristics of said three metals with the heat of friction produced at said sealing ring-wear face interface being efficiently conducted from said wear face through said proximate common juncture to said bearing and pump housings and thence to ambient.

* * * * *